United States Patent [19]

Vitt et al.

[11] Patent Number: 5,042,852

[45] Date of Patent: Aug. 27, 1991

[54] LATCH AND ROD GUARD ASSEMBLY

[75] Inventors: Roger A. Vitt; Jorge A. Navarro, both of Indianapolis; Paul J. Haeck, Carmel, all of Ind.

[73] Assignee: Von Duprin, Inc., Indianapolis, Ind.

[21] Appl. No.: 592,233

[22] Filed: Oct. 3, 1990

[51] Int. Cl.[5] ..... E05C 9/04

[52] U.S. Cl. ..... 292/21; 292/337; 292/DIG. 53; 49/141

[58] Field of Search ..... 292/21, 92, 218, 40, 292/337, DIG. 32, DIG. 53; 49/141, 460, 462

[56] References Cited

U.S. PATENT DOCUMENTS

| | | | |
|---|---|---|---|
| 2,752,773 | 7/1956 | Abelson et al. | 292/92 X |
| 3,060,523 | 10/1962 | Benham | 49/460 |
| 4,095,372 | 6/1978 | Rittner | 49/460 |
| 4,344,253 | 8/1982 | Stile | 49/462 X |

FOREIGN PATENT DOCUMENTS

| | | | |
|---|---|---|---|
| 2308767 | 11/1976 | France | 292/DIG. 32 |

*Primary Examiner*—Richard E. Moore

*Attorney, Agent, or Firm*—Walter C. Vliet; Bernard J. Murphy

[57] ABSTRACT

The assembly has a multi-tabbed bracket for fixing to a door behind, and parallel with, a latch-actuating rod, and a semi-circular rod guard with latching fingers for slidable engagement with the tabs of the bracket for enclosing and protecting the latch-actuating rod. In addition, the assembly has a shroud-like guard for emplacement over a rod-actuated latch. The shroud-like latch guard has a ramped surface which, when the guard is in place, presents an impingement surface for wheeled devices to facilitate an opening of the door. The shroud-like guard, then, both protects the latch over which it is emplaced and makes the opening of the door more facile.

16 Claims, 4 Drawing Sheets

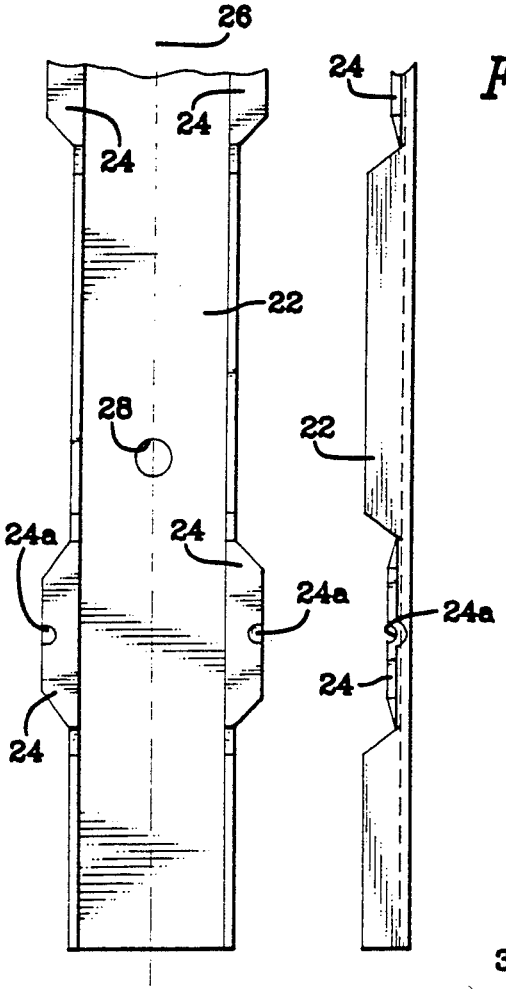
FIG. 4
FIG. 5
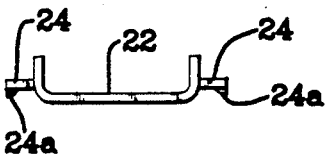
FIG. 6
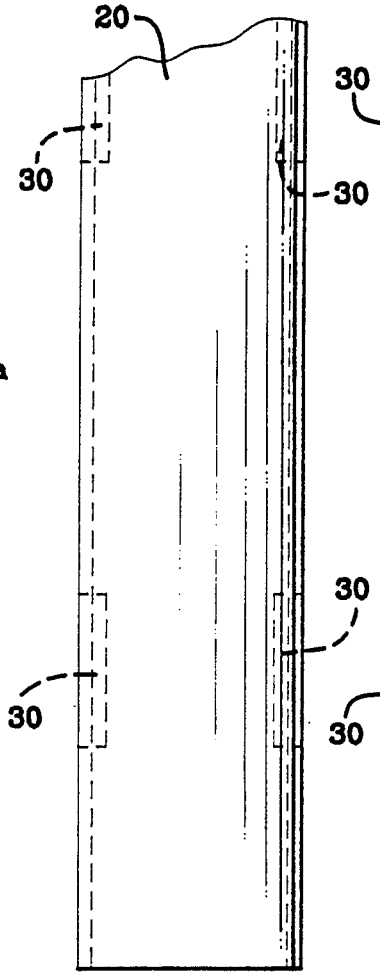
FIG. 7
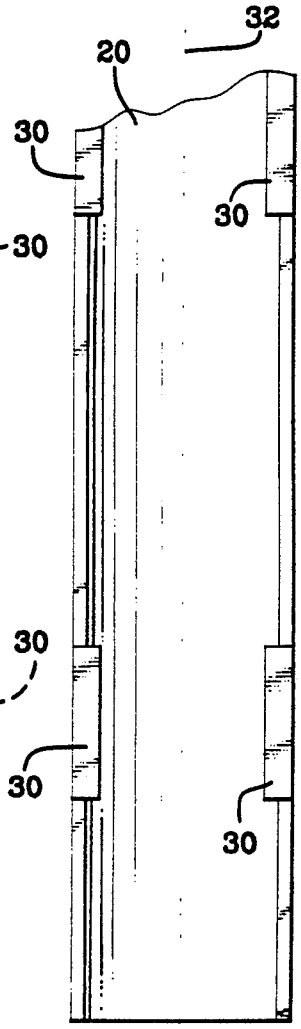
FIG. 8
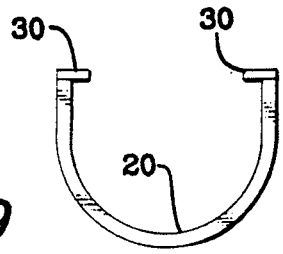
FIG. 9

LATCH AND ROD GUARD ASSEMBLY

BACKGROUND OF THE INVENTION

This invention relates generally to panic exit devices which have rod-actuated, surface-mounted, door latches, and more particularly to a latch and rod guard assembly therefor designed to (a) protect the door latches and actuating rods from damage, and (b) to facilitate an opening of a door, upon which such an exit device is mounted, by wheeled devices, such as wheelchairs, laundry carts, and the like.

A panic exit device which has rod-actuated, surface-mounted, door latches creates an obstruction to handicapped, wheelchaired persons, as well as to gurneys, laundry carts, etc. Such devices inhibit a facile opening of the associated door. The bottom bumper of the wheelchairs, or the frames of the gurneys and carts strike the actuating rod of the lower latch, or the latch cover itself. Coincidentally, too, such impingement causes damage to the actuating rods and the latch covers and latches.

There are jurisdictions, notably the State of California, for instance, which have published Accessibility Standards which define requirements for doors which will allow such to be opened easily by a wheelchaired person.

In view of the foregoing, it is apparent that it would be advantageous to provide means which will both protect door latches and actuating rods from damage, and facilitate an opening of a door upon which the same are mounted when encountered by a wheeled device.

SUMMARY OF THE INVENTION

In one aspect of the invention, the aforementioned means is provided in a latch and rod guard assembly, for an exit device having rod-actuated, surface-mounted, door latches, which comprises a bracket for fastening thereof to a door behind, and parallel with, a latch-actuating rod; and a rod guard; wherein the bracket has means for (a) slidably receiving the rod guard, and (b) holding the rod fast thereto; and a latch guard having means for (a) covering and (b) protecting a rod-actuated, surface-mounted door latch.

The foregoing and other aspects will become apparent from the following description of the invention when considered in conjunction with the accompanying drawing figures.

BRIEF DESCRIPTION OF THE DRAWING FIGURES

FIGS. 2 and 3 are considerably enlarged over the scale of FIG. 1;

FIG. 4 is a plan view of an end portion of a rod guard bracket;

FIG. 5 is a side elevational view of the bracket portion of FIG. 4;

FIG. 6 is an end view of the rod guard bracket, the same having been taken from the lower, finished end of the bracket portion of FIG. 4;

FIG. 7 is a plan view of the exterior of an end portion of the rod guard;

FIG. 8 is a plan view of the interior of the rod guard end portion of FIG. 7;

FIG. 9 is an end view of the rod guard, the same having been taken from the lower, finished end of the guard portion of FIG. 8;

FIGS. 4 through 12 are in a scale of approximately twice that of FIGS. 2 and 3.

DETAILED DESCRIPTION

Figure 1:
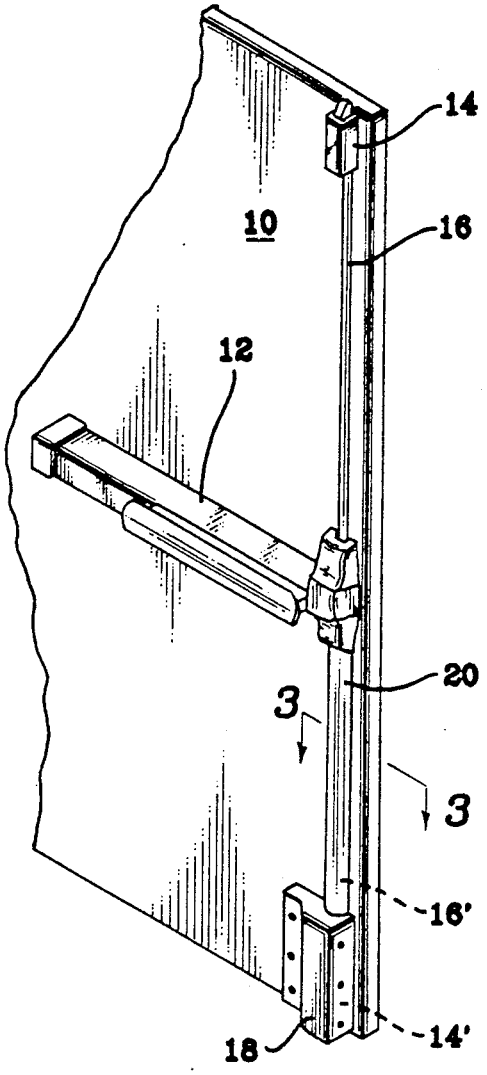
FIG. 1 is a perspective illustration of a portion of a door upon which is mounted a rod-actuated, surface-mounted, door-latching panic exit device, the same showing an embodiment of the invention installed thereon.
Figure 3:
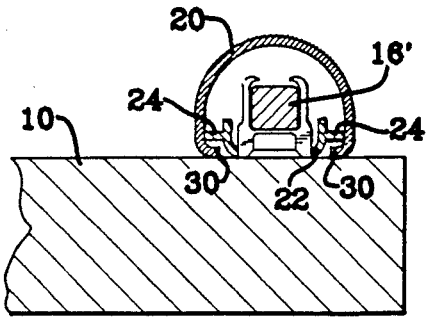
FIG. 3 is a cross-sectional view taken along Section 3—3 of FIG. 1.

Referring now to the drawings, FIG. 1 illustrates a portion of a door 10 which has a panic exit device 12 mounted thereon, the device 12 having top and bottom latches (only the top latch 14 being visible) which are actuated by rods (only the top-latch-actuating rod 16 being visible). The lower latch 14' is covered by a shroud 18, and the lower-latch-operating rod 16' is covered by a rod guard 20.

Shroud 18 serves as a guard for the lower latch 14'; it substantially fully encloses the latch 14' Similarly, the rod guard 20 fully covers and obscures the rod 16'. With particular reference to FIGS. 3 through 8, it can be appreciated how the rod guard 20 is emplaced upon the door 10 to cover and protect the rod 16'. The lower end of the rod 16' is detached from the bottom or lower latch 14' (by means well within the ken of those of ordinary skill in this art, and not requiring explanation here). The rod 16', then, is moved or slewed out of the way in order that a rod guard bracket 22 can be fastened to the door 10. Bracket 22, which defines a shallow U-shape, has a plurality of tabs 24 which extend outwardly, from opposite sides of a longitudinal axis 26 of the bracket 22, and fastener-receiving holes 28 (only one is shown). The bracket 22 is set upon the door 10, being positioned so that it will occupy a position behind, and parallel with, the rod 16' (when the rod 16' is in its normal disposition for operation), and is fixed in place with fasteners. The aforesaid positioning requires that sufficient room be left toward the bottom of the door, whereat the latch 14' is mounted, to accommodate a latch guard, i.e., the shroud 18, and to insure that the lower end of the rod guard 20 will abut the shroud 18.

The rod 16' is then attached to the lower latch 14'. Now the rod guard 20 is set into engagement with the bracket 22. Guard 20 has a plurality of fingers 30 which extend inwardly, relative to the guard 20, along opposite sides of a longitudinal axis 32 of the guard. The fingers are so spaced apart as to slidably engage the similarly spaced apart tabs 24 of the bracket 22. Accordingly, the guard 20 is set upon the bracket 22, with the fingers 30 positioned between the tabs 24. Then the guard 20 is slid lengthwise, being forced therealong by means of a mallet, or the like. The fingers 30 slide under, and engage, the tabs 24, to hold the guard 20 in place over the bracket 22 and rod 16'. Dimples **24*a*, the same being semi-circular reliefs formed in the outer edges of the tabs 24, constrain the guard 20 fast to the door. It is especially to be noted that, with the guard 20 in place, both the bracket 22 and rod 16' are covered and obscured. Too, the rod 16' is protected from impacts. The guard 20**, having a continuous, uninterrupted surface on its exterior, presents no significant obstruction to any wheeled vehicle which strikes it.

Figure 2:
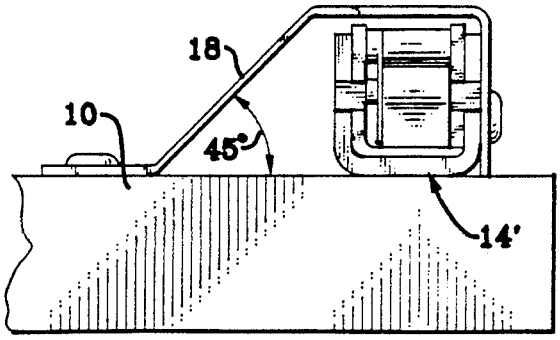
FIG. 2 is a view, from the bottom of the door, showing the latch guard in place over the bottom latch.
Figure 10:
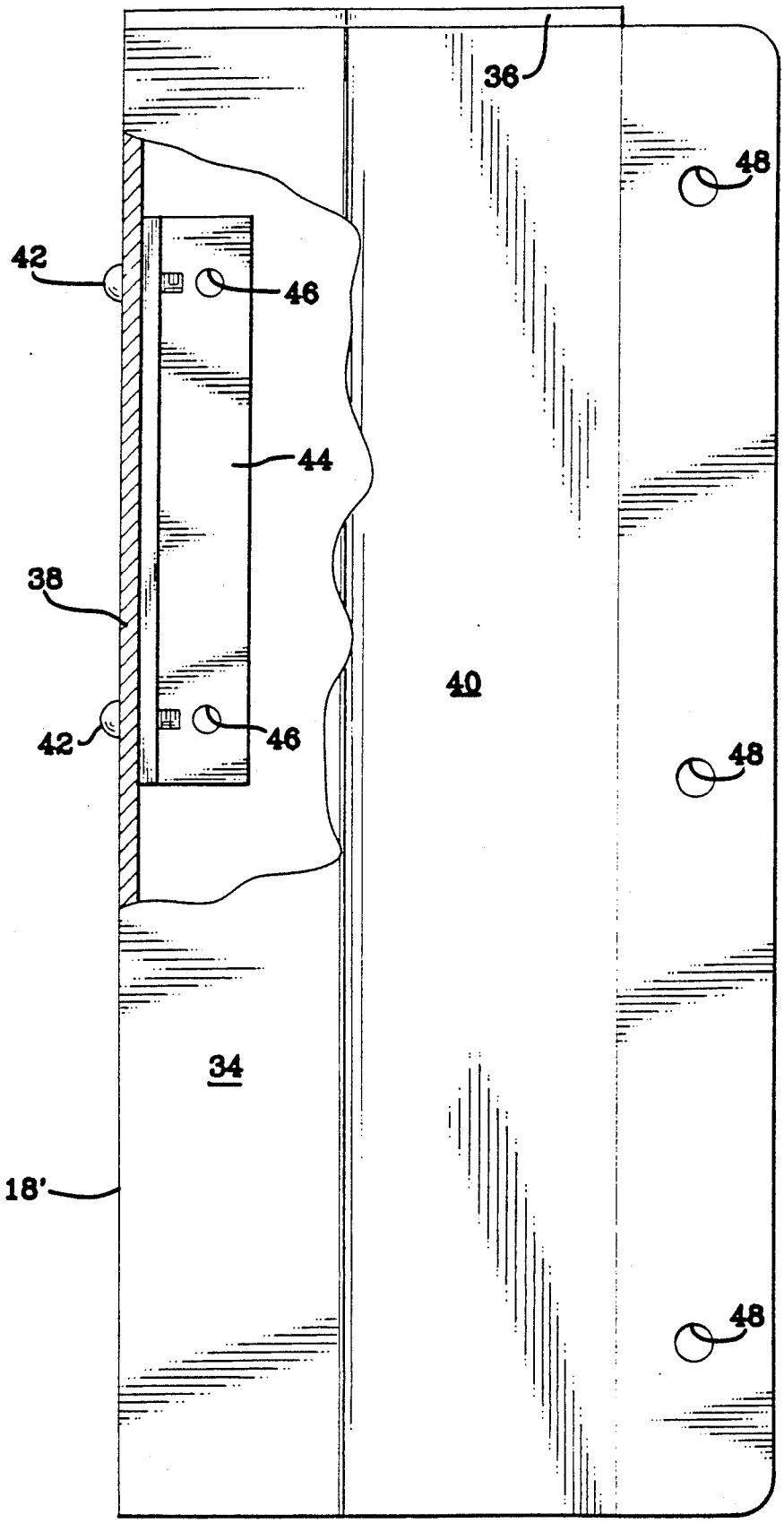
FIG. 10 is a plan view of the latch guard, a portion of the flat top thereof being cut away to show the latch guard bracket.
Figure 11:
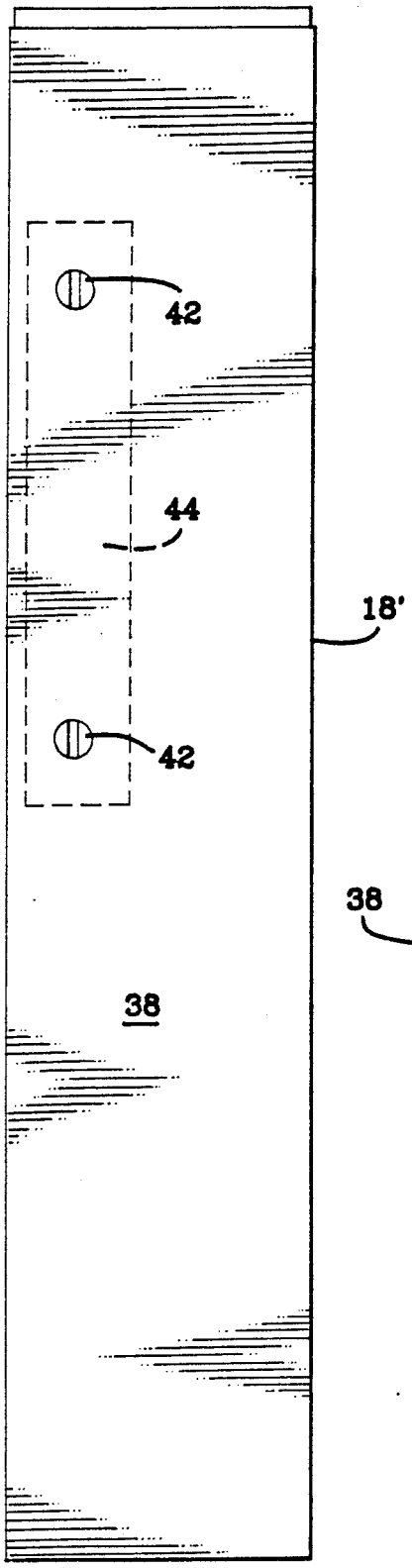
FIG. 11 is a side view of the latch guard, the same taken from the left-hand side of FIG. 10.
Figure 12:
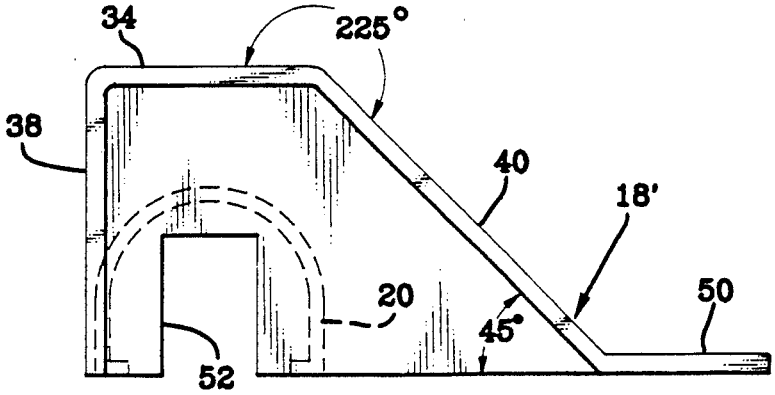
FIG. 12 is an end view of the latch guard, the same having been taken from the bottom of FIG. 10.

The latch-guarding shroud 18 shown in FIGS. 1 and 2 is for a right-hand door 10, i.e., a door which is hinged at the left-hand side and has its right-hand side slew. The invention comprehends either handedness of doors. The latch guard shroud 18' shown in FIGS. 10 through 12 is configured for a left-hand door.

Latch guard shroud 18' has a flat top 34, an end wall 36, a side wall 38, and a ramped wall 40. The end thereof, opposite wall 36, is open. Side wall 38 has a pair of bolt holes formed therein to receive bolts 42. Bolts 42 are threadedly received in tapped holes provided therefor in a bracket 44, of right-angular cross-section, which is used to mount the shroud 18' in place on the door. Bracket 44 has another pair of bolt holes 46 which are used to receive fasteners for fixing the bracket to the door in close adjacency to the lower latch 14'. Additionally, the shroud 18' has a plurality of further bolt holes 48 formed in an apron 50 thereof also for fastening of the shroud 18' to the door. With the bracket 22 and rod guide 20 having been carefully positioned to fit the shroud 18' immediately therebelow, the rod guide 20 makes an interfacing engagement with the end wall 36 of the shroud 18'. This is represented by the phantomed outline of the end of the rod guide 20 in FIG. 12. A cut-out 52 accommodates the actuating rod 16' therethrough.

The ramped wall 40 defines an angle of approximately two hundred and twenty-five degrees of arc with the top 34. As a result, the wall 40 presents an approximately forty-five degree ramp to any wheeled device which impacts thereagainst, and facilitates the opening of the door by the device. Of equal importance, the shroud 18' protects the lower latch 14' from impacting damage.

Having described the invention, what is claimed is:

1. A latch and rod guard assembly, for an exit device having rod-actuated, surface-mounted, door latches, comprising:

a bracket means for fastening thereof to a door behind, and parallel with, a latch-actuating rod; and a rod guard; wherein said bracket means being provided for (a) slidably receiving said rod guard, and (b) holding said rod guard fast thereto; and a latch guard having means for (a) covering and (b) protecting a rod-actuated, surface-mounted door latch.

2. A latch and rod guard assembly, according to claim 1, wherein said rod guard has means for covering and obscuring said bracket means.

3. A latch and rod guard assembly, according to claim 1, wherein said receiving and holding means of said bracket means comprises a plurality of extending tabs.

4. A latch and rod guard assembly, according to claim 1, wherein said bracket means has a longitudinal axis; and said receiving and holding means of said bracket means comprises a plurality of tabs extending outwardly, from said bracket means, along opposite sides of said axis.

5. A latch and rod guard assembly, according to claim 3, wherein said rod guard has means for slidably engaging said tabs.

6. A latch and rod guard assembly, according to claim 5, wherein said rod guard has a longitudinal axis; and said means for engaging said tabs comprises a plurality of fingers extending inwardly, relative to said rod guard, along opposite sides of said axis.

7. A latch and rod guard assembly, according to claim 1, wherein in cross-section, said bracket means defines a shallow U-shape.

8. A latch and rod guard assembly, according to claim 1, wherein in cross-section, said rod guard defines a semi-circular shape.

9. A latch and rod guard assembly, according to claim 1, wherein said rod guard has means for covering and obscuring said bracket means, and protecting a latch-actuating rod.

10. A latch and rod guard assembly, according to claim 1, wherein said latch guard comprises a shroud which has a ramp surface thereon.

11. A latch and rod guard assembly, according to claim 10, wherein said shroud has a flat top into which said ramp surface fairs, a side wall and an end wall, which walls extend from said top right-angularly and, respectively, join said ramp surface and said top.

12. A latch and rod guard assembly, according to claim 11, wherein said top and ramp surface define an obtuse angle therebetween.

13. A latch and rod guard assembly, according to claim 12, wherein said angle is substantially two hundred and twenty-five degrees of arc.

14. A latch and rod guard assembly, according to claim 1, wherein said rod guard has an exterior and an interior;

said interior comprises means for (a) covering and obscuring said bracket means, and (b) covering and protecting a latch-actuating rod; and said exterior comprises a continuous, uninterrupted surface.

15. A latch and rod guard assembly, according to claim 11, wherein said side wall has a relief formed therein through which to accommodate an end of a latch-actuating rod.

16. A latch and rod guard assembly, according to claim 1, further including:

a second bracket means for fastening thereof to a door in adjacency to a door latch and for fastening said latch guard thereto.

* * * * *